US008413978B2

(12) United States Patent
Watanabe et al.

(10) Patent No.: US 8,413,978 B2
(45) Date of Patent: Apr. 9, 2013

(54) SHEET PROCESSING APPARATUS AND IMAGE FORMING SYSTEM

(75) Inventors: Naoto Watanabe, Abiko (JP); Manabu Yamauchi, Kashiwa (JP); Takayuki Fujii, Tokyo (JP); Satoru Yamamoto, Abiko (JP); Yushi Oka, Abiko (JP); Toshiyuki Miyake, Abiko (JP); Takashi Yokoya, Kashiwa (JP); Shunsuke Nishimura, Tokyo (JP); Hidenori Matsumoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 12/829,734

(22) Filed: Jul. 2, 2010

(65) Prior Publication Data

US 2011/0008089 A1 Jan. 13, 2011

(30) Foreign Application Priority Data

Jul. 8, 2009 (JP) ..... 2009-161391
Jun. 18, 2010 (JP) ..... 2010-138829

(51) Int. Cl.
*B26D 5/00* (2006.01)

(52) U.S. Cl.
USPC ..... 270/58.07

(58) Field of Classification Search ..... 399/407; 270/58.07; 83/76.6–76.9, 403.1
See application file for complete search history.

(56) References Cited

U.S. PATENT DOCUMENTS

| | | | | |
|---|---|---|---|---|
| 5,746,162 | A | 5/1998 | Hosoi et al. | |
| 7,021,616 | B2 | 4/2006 | Mizuta et al. | |
| 7,134,370 | B2 | 11/2006 | Murata et al. | |
| 2007/0057446 | A1 | 3/2007 | Nishimura et al. | |
| 2008/0122156 | A1 | 5/2008 | Fujii et al. | |
| 2008/0307939 | A1 * | 12/2008 | Smith | 83/331 |
| 2009/0103962 | A1 | 4/2009 | Fujii et al. | |
| 2009/0226204 | A1 * | 9/2009 | Sasaoka et al. | 399/82 |
| 2010/0158597 | A1 * | 6/2010 | Miyake | 399/407 |

* cited by examiner

*Primary Examiner* — Leslie A Nicholson, III

(74) *Attorney, Agent, or Firm* — Fitzpatrick, Cella, Harper & Scinto

(57) ABSTRACT

A sheet processing apparatus includes a punch portion punching a hole at an end part of a sheet, and a push-out member discharging the sheet by pushing the end part of the sheet where the punch process is performed by the punch portion. The push-out member discharges the sheet at a sheet discharging speed lower than a predetermined speed from the intermediate process tray in accordance with punch process information (i.e., combination of a size and a type of the sheet and number, a shape and a size of holes) that strength of a sheet end part is decreased by the punch process, and is lower than predetermined sheet strength capable of being discharged at the predetermined speed.

13 Claims, 12 Drawing Sheets

| | 4 HOLES | 30 CIRCULAR HOLES | 30 RECTANGULAR HOLES |
|---|---|---|---|
| ID | 1 | 2 | 3 |
| NUMBER OF HOLES | 4 | 30 | 30 |
| HOLE DIAMETER | 8 mm | 6 mm | 6 mm |
| SHAPE | CIRCLE | CIRCLE | SQUARE |

FIG. 7

| | WITHOUT PUNCH | | | 4 HOLES | | | 30 CIRCULAR HOLES | | | 30 RECTANGULAR HOLES | | |
|---|---|---|---|---|---|---|---|---|---|---|---|---|
| ID | - | | | 1 | | | 2 | | | 3 | | |
| NUMBER OF HOLES | - | | | 4 | | | 30 | | | 30 | | |
| HOLE DIAMETER | - | | | 8 mm | | | 6 mm | | | 6 mm | | |
| SHAPE | - | | | CIRCLE | | | CIRCLE | | | SQUARE | | |
| SHEET TYPE | THIN PAPER | | | THIN PAPER | PLAIN PAPER | THICK PAPER | THIN PAPER | PLAIN PAPER | THICK PAPER | THIN PAPER | PLAIN PAPER | THICK PAPER |
| SHEET DISCHARGE METHOD (LENGTH: 364 mm OR LONGER) | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | SECOND DISCHARGE CONTROL | FIRST DISCHARGE CONTROL | FIRST DISCHARGE CONTROL | DISCHARGE BAN NOTIFICATION | FIRST DISCHARGE CONTROL | FIRST DISCHARGE CONTROL |
| SHEET DISCHARGE METHOD (LENGTH: SHORTER THAN 364 mm) | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | SECOND DISCHARGE CONTROL | FIRST DISCHARGE CONTROL | FIRST DISCHARGE CONTROL |

| [FIRST DISCHARGE CONTROL] | | [SECOND DISCHARGE CONTROL] |
|---|---|---|
| DISCHARGE SPEED V1 | > | DISCHARGE SPEED V2 |
| DISCHARGE ACCELERATION Va1 | > | DISCHARGE ACCELERATION Va2 |

FIG. 10

| | WITHOUT PUNCH | | | 4 HOLES | | | 30 CIRCULAR HOLES | | | 30 RECTANGULAR HOLES | | |
|---|---|---|---|---|---|---|---|---|---|---|---|---|
| ID | - | | | 1 | | | 2 | | | 3 | | |
| NUMBER OF HOLES | - | | | 4 | | | 30 | | | 30 | | |
| HOLE DIAMETER | - | | | 8 mm | | | 6 mm | | | 6 mm | | |
| SHAPE | - | | | CIRCLE | | | CIRCLE | | | SQUARE | | |
| SHEET TYPE | THIN PAPER | | | THIN PAPER | PLAIN PAPER | THICK PAPER | THIN PAPER | PLAIN PAPER | THICK PAPER | THIN PAPER | PLAIN PAPER | THICK PAPER |
| SHEET DISCHARGE METHOD (LENGTH: 364 mm OR LONGER) | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | SECOND DISCHARGE CONTROL | FIRST DISCHARGE CONTROL | FIRST DISCHARGE CONTROL | THIRD DISCHARGE CONTROL | FIRST DISCHARGE CONTROL | FIRST DISCHARGE CONTROL |
| SHEET DISCHARGE METHOD (LENGTH: SHORTER THAN 364 mm) | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | FIRST DISCHARGE CONTROL | SECOND DISCHARGE CONTROL | FIRST DISCHARGE CONTROL | FIRST DISCHARGE CONTROL |

SHEET PROCESSING APPARATUS AND IMAGE FORMING SYSTEM

BACKGROUND OF THE INVENTION

1. Field of the Invention

The present invention relates to a sheet processing apparatus capable of performing a punch process on a sheet and an image forming system including the sheet processing apparatus.

2. Description of the Related Art

In the related art, there has been proposed a sheet processing apparatus in which sheets respectively having an image formed by an image forming apparatus are conveyed sequentially into an apparatus and a punch process to punch holes can be performed thereon. For example, a sheet processing apparatus on which a punch unit having different number, diameter and position of holes is exchangeably disposed to support a variety of files and rings with a single sheet processing apparatus has been proposed, as disclosed in U.S. Pat. No. 5,746,162.

Further, in the above sheet processing apparatus, punch-processed sheets are eventually discharged to a stack tray while performing a process such as aligning and stapling after being sequentially stacked on a processing tray for temporal stacking by being switched back.

With the sheet processing apparatus proposed in U.S. Pat. No. 5,746,162, when a punch process of a number of holes such as 30 holes is performed, the strength of the sheet end part of the punch-processed side is decreased. Accordingly, when the sheets are stacked on the processing tray and discharged to the stack tray from the processing tray as an ordinary punch process with a few holes such as 2 to 4 holes, there is a fear that following problems occur.

For example, sheets having the punch process of a number of holes performed at the end part thereof are sequentially stacked on the processing tray and alignment is performed by striking the end part of each punch-processed sheet to an abutment member on the processing tray after each sheet is switched back at the sheet tray.

And then, the sheets being aligned at the processing tray are discharged to the stack tray from the processing tray by being pushed by a discharge member movable along the processing tray. At that time, when the sheet is thin, there is a fear that the sheet is buckled as the discharge member pushes out the end part of the punch-processed sheet.

The present invention prevents buckling at an end part of a punch-processed sheet.

SUMMARY OF THE INVENTION

According to the present invention, there is provided a sheet processing apparatus including: a punch portion which punches a hole at an end part of a sheet; a sheet discharge portion which discharges the sheet by pushing the end part of the sheet where the punch process is performed by the punch portion; and a controller which controls the sheet discharge portion, wherein the controller controls so that the sheet discharge portion discharges a sheet at a sheet discharging speed lower than a predetermined speed in accordance with punch process information that strength of a sheet end part is decreased by the punch process and is lower than predetermined sheet strength capable of being discharged at the predetermined speed.

According to the present invention, buckling at an end part of a sheet of which strength is decreased due to a punch process can be prevented. Accordingly, a sheet product on which a high quality punch process is performed can be provided to a user.

Further features of the present invention will become apparent from the following description of exemplary embodiments with reference to the attached drawings.

BRIEF DESCRIPTION OF THE DRAWINGS

FIG. 7 is a table which indicates an example of a discharge control table according to a first embodiment;

FIG. 10 is a table which indicates an example of a discharge control table according to a second embodiment;

DESCRIPTION OF THE EMBODIMENTS

In the following, embodiments of the present invention will be described in detail as examples with reference to the drawings. Here, dimensions, materials, shapes, relative arrangements thereof and the like described in the following embodiments are to be appropriately modified in accordance with a configuration of an apparatus to which the present invention is applied and various conditions. Therefore, the embodiments are not intended to limit the scope of the present invention only to the description unless otherwise specified.

First Embodiment

In the following, an image forming system constituted with an image forming apparatus main body and a sheet processing apparatus according to a first embodiment will be described.

General Configuration of Image Forming System

Figure 1:
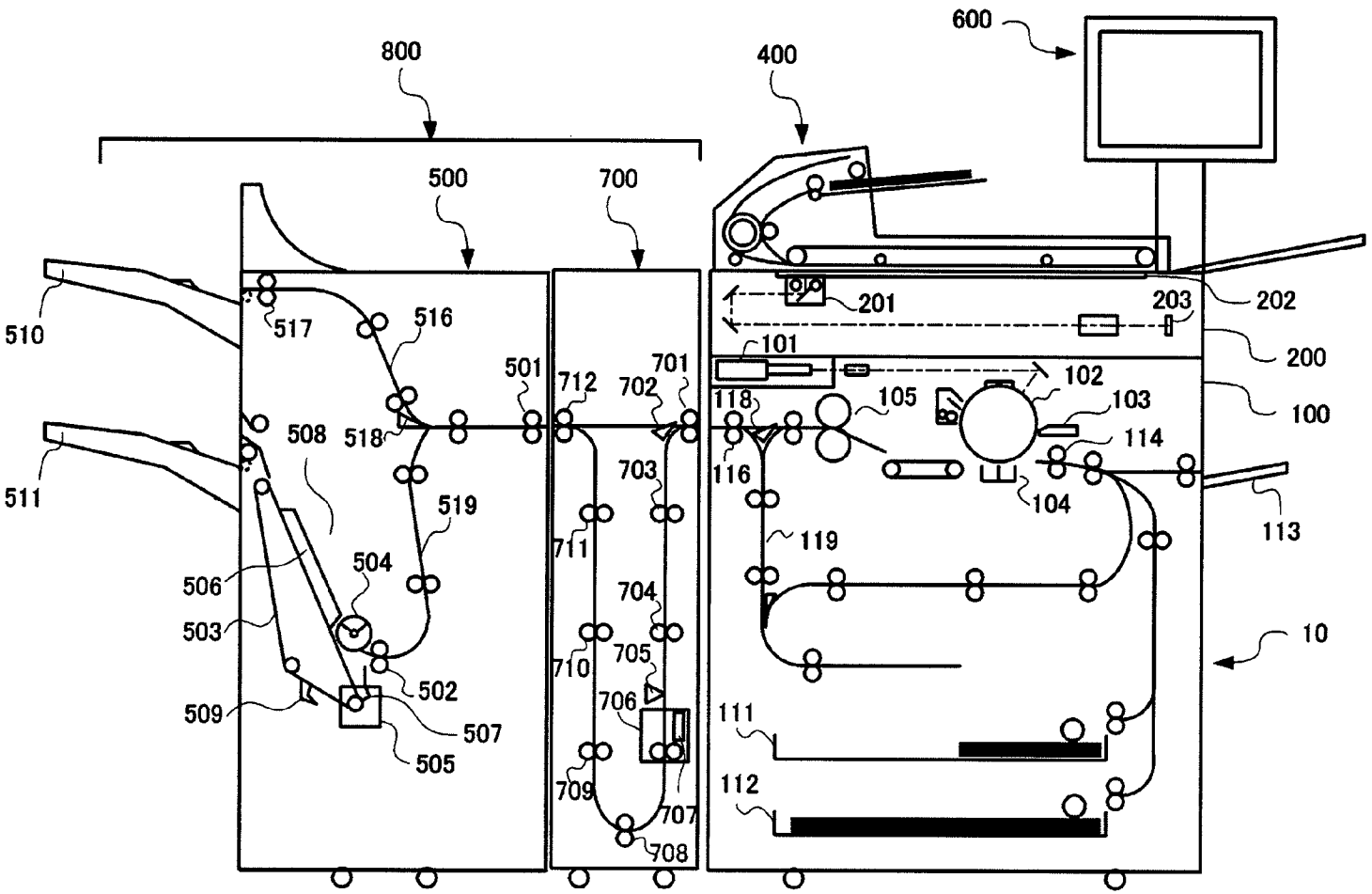
FIG. 1 is a structural view of an entire image forming apparatus.

First, a general configuration of an image forming system constituted with an image forming apparatus main body and a sheet processing apparatus will be described. FIG. 1 is a schematic sectional view illustrating the general configuration of the image forming system.

As illustrated in FIG. 1, the image forming system is constituted with an image forming apparatus main body 10 and a finisher 800 as the sheet processing apparatus. The image forming apparatus main body 10 includes an image reader 200 to read an image of an original and a printer 100 to record an image on a sheet. Further, the image forming apparatus main body 10 includes an operation displaying portion 600. The finisher 800 is the sheet processing apparatus (i.e., sheet processing portion) selectively performing a process on an image-formed sheet and stacking the sheet. Here, the finisher 800 includes a punch unit 700 having a punch portion capable of selectively punching different types of holes against a sheet and a staple stacker portion 500 capable of selectively performing a process on a sheet.

The image reader 200 mounts an original feeding unit 400. The original feeding unit 400 feeds originals set faced-up on an original tray sequentially one by one from the top page and stops the original at a predetermined position on a platen glass 202 via a curved path. By performing scanning with a scanner unit 201 in this state, the original is read. At the time of scanning with the scanner unit 201, the reading face of the original is irradiated with light of a lamp of the scanner unit 201 and the reflection light from the original is guided to a lens via a mirror. The light which passed through the lens forms an image at an imaging face of an image sensor 203. The optically read image is output after being converted into image data by the image sensor 203. The image data output from the image sensor 203 is input to an exposure controlling portion 101 of the printer 100 as a video signal after a predetermined process is performed with a later-mentioned image signal controlling portion 281.

Following description is performed on a case of forming an image on one side of a sheet. At an image forming portion of the printer 100, an exposure controlling portion 101 modulates and outputs laser light based on an input video signal. The laser light is irradiated on a photosensitive drum 102 as being scanned by a polygon mirror (not illustrated). An electrostatic latent image is formed on the photosensitive drum 102 in accordance with the scanned laser light. The electrostatic latent image on the photosensitive drum 102 is to be visible as a developer image with developer supplied from a development device 103.

A sheet conveyed and fed to a conveying path from each cassette 111, 112 or a manual sheet tray 113 is tentatively stopped by the top end of the sheet being struck to a registration roller 114. Subsequently, the sheet is conveyed to a space between the photosensitive drum 102 and a transfer portion 104 at the timing synchronized with starting irradiation of the laser light. The developer image formed on the photosensitive drum 102 is transferred on the fed sheet by the transfer portion 104. Skew of the sheet is corrected with the tentative stop by the top end of the sheet being struck to the registration roller 114.

The sheet having the developer image transferred is conveyed to a fixing portion 105. The fixing portion 105 fixes the developer image on the sheet by applying heat and pressure to the sheet. The sheet passing through the fixing portion 105 is discharged to the finisher 800 from the printer 100 via a discharge roller 116 by a switching member 118. At that time, the sheet is discharged in a state that the image-formed face is faced upward (i.e., face-up).

When discharging the sheet in a state that the image-formed face is faced downward (i.e., face-down), the sheet is conveyed to a reverse path 119 as being switched back by switching the switching member 118 after passing through the fixing portion 105. Accordingly, the sheet is reversed in the front and back and discharged to the finisher 800 from the printer 100 via the discharge roller 116.

The sheet discharged from the printer 100 is fed to the finisher 800. The finisher 800 is capable of selectively performing a process such as a stapling process, a punch process and a sort process on a sheet bundle. Selecting and cancelling of a stapling mode, a punch mode and a sort mode can be performed at the operation displaying portion 600. The finisher 800 is a unit mainly constituted with the staple stacker portion 500 and includes the punch unit 700 to perform a punch process.

When the punch process is not set, the sheet discharged from the printer 100 is conveyed in the horizontal direction by a conveying roller 701 and a switching member 702 at an inlet of the punch unit 700. Then, the sheet is conveyed to the staple stacker portion 500 by a conveying roller 501 at an inlet of the staple stacker portion 500 via a discharge roller 712. In the case that the processes such as sorting and stapling are not set and the sheet is discharged without being processed, a switching member 518 is switched and the sheet is discharged to a stack tray 510 by a discharge roller 517 being a second sheet discharge portion via a non-sort path 516.

Next, sheet conveyance in the case that the process such as sorting and stapling is set against the sheet will be described.

After performing image forming being similar to the case of performing image forming on one side of a sheet, the sheet is conveyed to a reverse path 119 to be switched back by switching the switching member 118 after passing through the fixing portion 105. Accordingly, the sheet is reversed in the front and back and discharged to the finisher 800 from the printer 100 in a state of face-down. In order to perform the process on the sheet, the sheet is discharged to a bundle discharge belt 503 by the conveying rollers 501, 502 of the finisher 800 via a sort path 519.

To be precise, the sheet is discharged to the intermediate process tray 508 having low friction which is arranged in parallel to the bundle discharge belt 503 at a higher position by several millimeters. The discharged sheet falls under its own weight in the lower right direction along the intermediate process tray 508 (i.e., the bundle discharge belt 503) which is obliquely arranged. The intermediate process tray 508 is a first stack portion capable of temporally stacking the sheet at the downstream side in the sheet conveying direction from a punch portion 706. The sheet discharged to the intermediate process tray 508 is abutted with a friction member arranged at an arc of a sector-shaped return roller 504 due to rotation of the return roller 504 in the counterclockwise direction, so that the end part of the sheet is struck to a stopper plate (i.e., an abutment member) 507. In this manner, aligning operation is performed in the longitudinal direction (i.e., the conveying direction) of the sheet.

Further, an aligning plate 506 is arranged on the intermediate process tray 508 respectively at both front and back sides. The aligning plates 506 are driven every time when a sheet is discharged onto the intermediate process tray 508, so that the aligning operation is performed in the lateral direction (i.e., the width direction perpendicular to the conveying direction) against the sheet on the intermediate process tray 508.

When a predetermined number of sheets are discharged and stacked on the intermediate process tray 508, the bundle discharge belt 503 constituting a first sheet discharge portion is driven to discharge the sheet bundle. Specifically, the sheet bundle is discharged to a stack tray 510 or a stack tray 511 being a second stack portion while the rear end of the sheet bundle (i.e., the sheet end part) is pushed out by a push member (i.e., a discharge portion) 509 operated along with driving of the bundle discharge belt 503.

When the stapling mode is set at the operation displaying portion 600, sheets for one bundle to be stapled are discharged to the intermediate process tray 508. After the aligning operation is performed to each sheet by the aligning plates 506, the stapling process is performed on the sheet bundle as a stapler 505 being a processing portion is driven. Subsequently, the sheet bundle is discharged to the stack tray 510 or the stack tray 511 by the sheet discharge belt 503.

The stapler 505 is movable in the lateral direction and is capable of performing the stapling operation at an arbitrary position between the front and back sides against the sheets on the intermediate tray 508. The position where the stapling process is performed is set at the operation displaying portion 600.

Next, sheet conveyance in the case that the punch process is set against a sheet will be described.

The sheet discharged from the printer 100 is conveyed into the punch unit 700 by the conveying roller 701 and conveyed to a path of conveying rollers 703, 704 side by switching the switching member 702 to the lower direction. When a predetermined time passes after the rear end of the sheet is detected by a sensor 705, a roller in the punch portion 706 is stopped and a push-out plate 707 is rotated by 90°. Then, by switching back the sheet, the sheet is struck to the push-out plate 707. Punch holes are punched at the rear end (i.e., the end part) of the sheet by the punch portion 706. After the punch process is completed, the push-out plate 707 is returned in the direction of the original position by 90° and the roller in the punch portion 706 is driven again. Then, the sheet is conveyed to the staple stacker portion 500 by the conveying rollers 708, 709, 710, 711, 712.

Figures 5A, 5B:
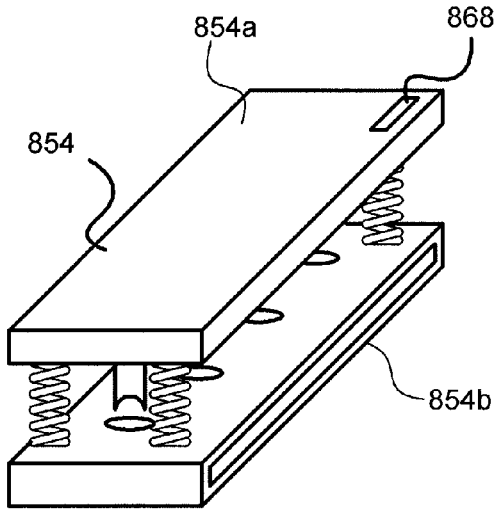
FIG. 5A is a perspective view of a punch die and FIG. 5B is a table which indicates types of the punch die.

FIG. 5A illustrates a punch die (i.e., blade portion) 854 provided at the punch portion 706 of the punch unit 700. FIG. 5B is a table indicating examples of types of the punch die. Although not illustrated in FIG. 1, the punch die 854 is provided with a punch blade 854*a* and a blade rest 854*b* for punching a hole. The punch process is performed by pressing an upper part of the punch die 854 when a sheet is passing through the punch die 854. The punch die 854 is replaceable (i.e., detachably attachable) and various hole types (i.e., the number, shape and size) of punch dies 854 are prepared.

Further, a non-contact communication IC chip (hereinafter, called the IC tag) 868 with an antenna of passive tag type is mounted on the upper part of the punch die 854. Information of the punch die 854 is possible to be discerned by a punch die reading controlling portion 873 illustrated in FIG. 3 through communication of the IC tag 868 with a non-contact communication IC reading unit (hereinafter, called the IC tag reader; not illustrated). Here, the type of the punch die 854 is discerned by utilizing a non-contact communication IC. However, instead of non-contact communication, it is also possible to communicate with the IC tag of the punch die 854 by utilizing wired connection by drawer, for example. Instead, not utilizing a communicating portion, it is also possible to perform discrimination of punch hole types by an optical sensor as a flag being mounted on a part of the punch die 854 and a cutout of the flag being provided to the punch unit 700.

Figure 6A:
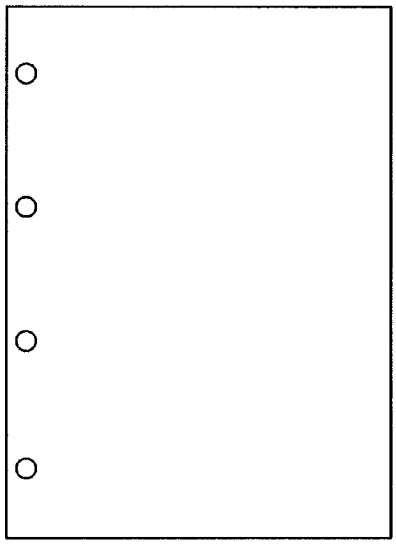
FIGS. 6A to 6C are plane views of a sheet after performing a punch process respectively of 4 circular holes, 30 rectangular holes and 30 circular holes.
Figure 6B:
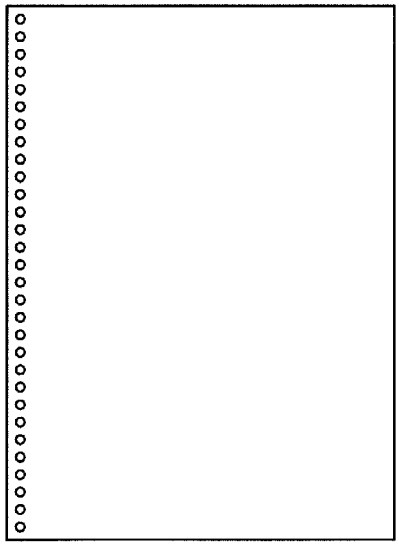
Figure 6C:
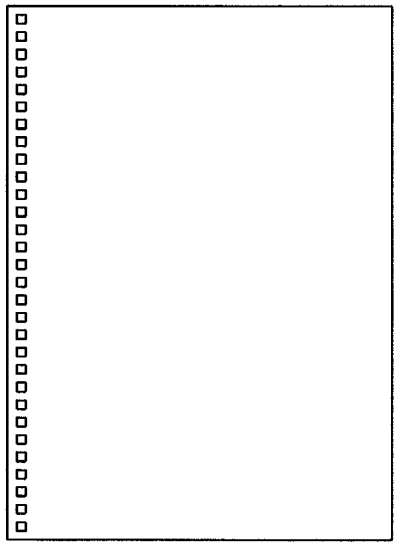

Here, the types of the punch die 854 are exemplified with 4 circular holes, 30 circular holes and 30 rectangular holes. FIGS. 6A to 6C respectively illustrate a punch-processed sheet using each of the punch dies 854. FIG. 6A is a plane view of a punch-processed sheet using a punch die of 4 circular holes. FIG. 6B is a plane view of a punch-processed sheet using a punch die of 30 circular holes. FIG. 6C is a plane view of a punch-processed sheet using a punch die of 30 rectangular holes. As illustrated in FIG. 5B, although the hole shapes are different, the number and intervals of the holes are the same between the sheets illustrated in FIGS. 6B and 6C.

Block Diagram of Image Forming System

Figure 2:
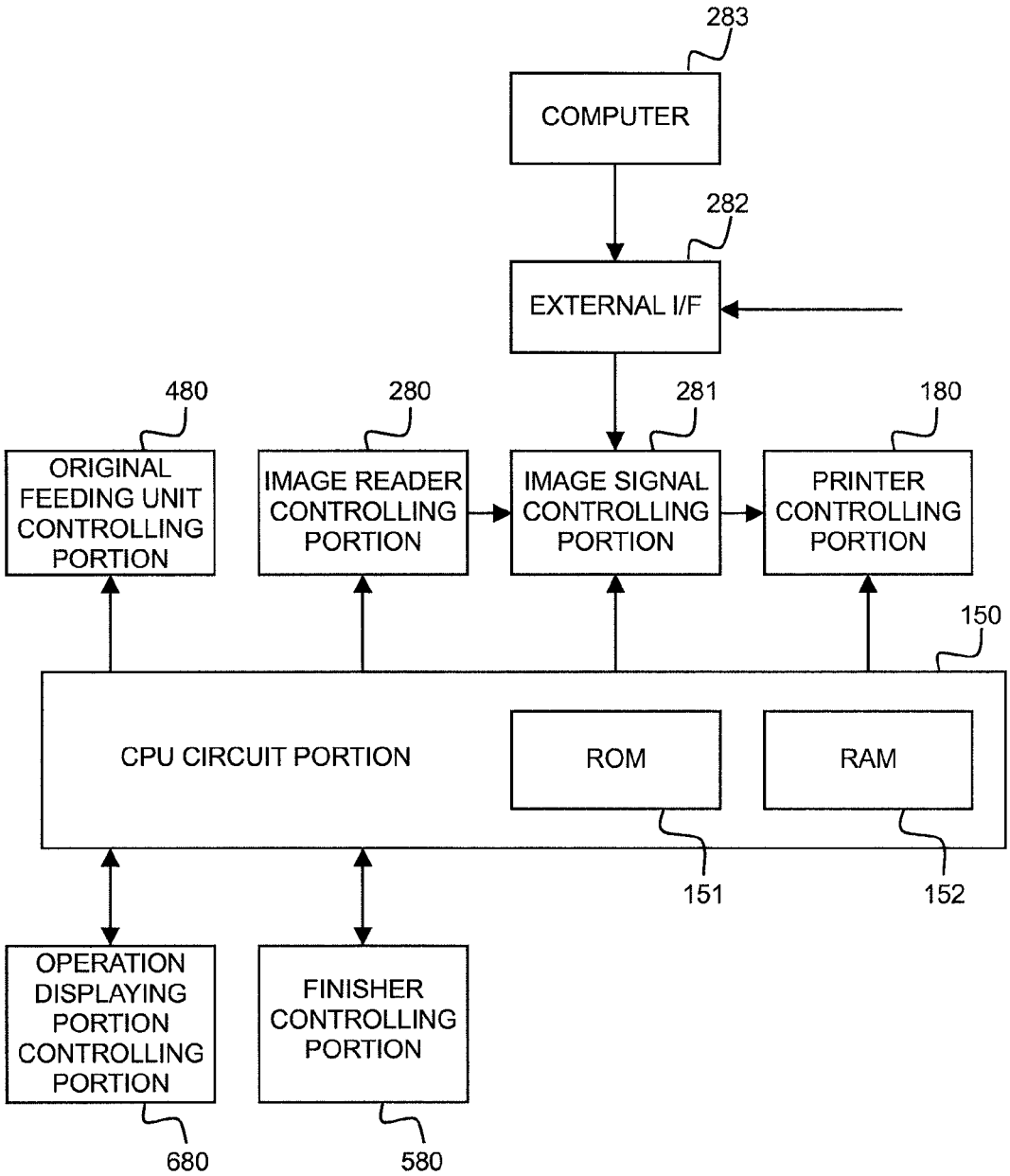
FIG. 2 is a block diagram of the image forming apparatus.

Next, the configuration of a controller to perform controlling of the entire image forming system will be described with reference to FIG. 2. FIG. 2 is a block diagram illustrating the configuration of the controller to perform controlling of the entire image forming system of FIG. 1.

As illustrated in FIG. 2, the controller includes a CPU circuit portion 150. The CPU circuit portion 150 incorporates a CPU (not illustrated), a ROM 151 and a RAM 152 and generally controls respective blocks 480, 280, 281, 282, 283, 180, 680, 580 with control programs stored at the ROM 151. The RAM 152 temporally stores control data and is used as an operational area for arithmetic processing in accordance with the control.

The original feeding unit controlling portion 480 controls to drive the original feeding unit 400 based on instructions from the CPU circuit portion 150. The image reader controlling portion 280 performs driving control against the above-mentioned scanner unit 201 and the image sensor 203 and transmits the analog image signal output from the image sensor 203 to the image signal controlling portion 281.

The image signal controlling portion 281 performs respective processes after converting an analog image signal from the image sensor 203 into a digital signal and converts the digital signal into a video signal, and then, outputs the video signal to the printer controlling portion 180. Further, the image signal controlling portion 281 performs various processes on a digital image signal input from a computer 283 via an external I/F 282 and converts the digital image signal into a video signal, and then, outputs the video signal to the printer controlling portion 180. The processing operation of the image signal controlling portion 281 is controlled by the CPU circuit portion 150. The printer controlling portion 180 drives the abovementioned exposure controlling portion 101 based on the input video signals.

The operation displaying portion controlling portion 680 interchanges information with the operation displaying portion 600 and the CPU circuit portion 150. The operation displaying portion 600 includes a plurality of keys to set various functions regarding image forming and a display portion to display information indicating a setting state. The operation displaying portion 600 displays corresponding information based on the signal from the CPU circuit portion 150 while outputting a key signal corresponding to operation of each key to the CPU circuit portion 150.

The finisher controlling portion 580 interchanges information with the CPU circuit portion 150 based on the information set from the operation displaying portion 600 and controls the finisher 800 in accordance with a sheet size and processing details.

The CPU circuit portion 150 performs a configuration when power is turned on and obtains each structural information by communicating with the original feeding unit controlling portion 480, the image reader controlling portion 280, the printer controlling portion 180 and the finisher controlling portion 580.

Figure 4A:
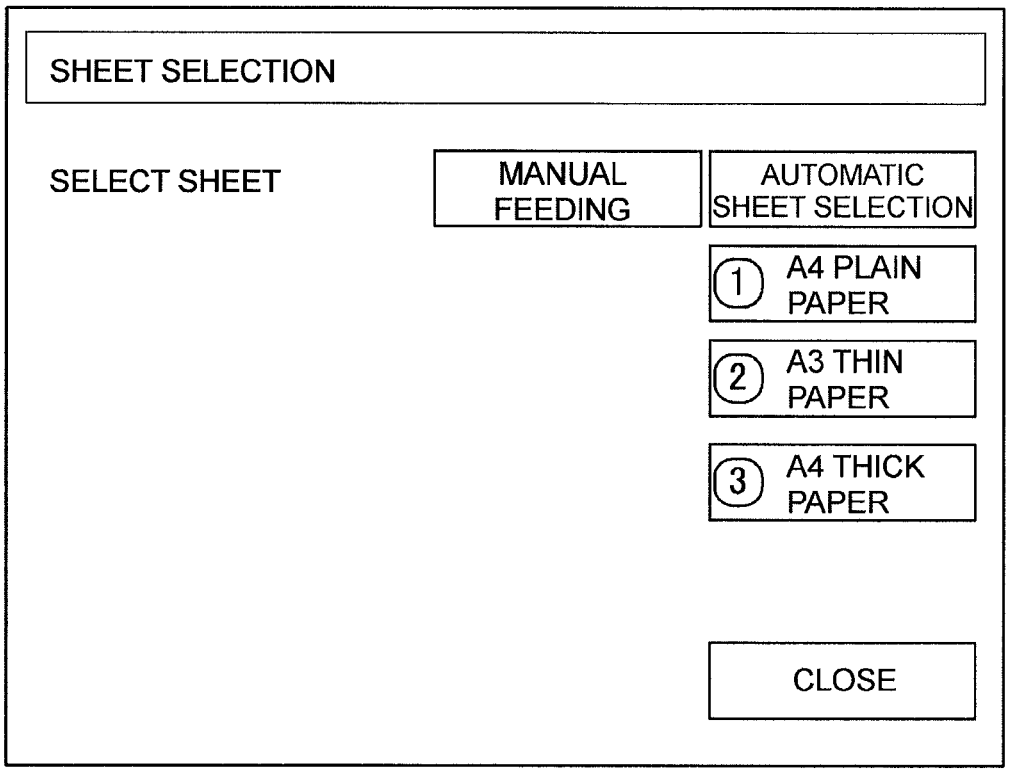
FIG. 4A illustrates a setting screen of a sheet type and FIG. 4B illustrates a setting screen of a process mode.
Figure 4B:
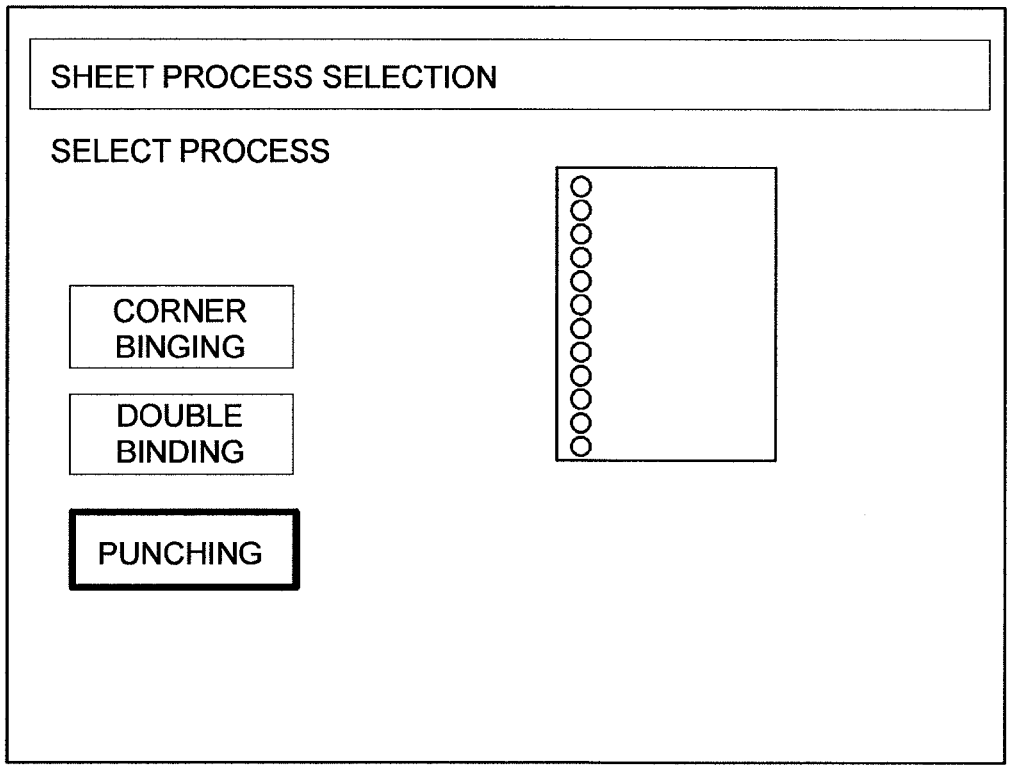

Next, setting procedure of the punch mode and sheets will be described. FIGS. 4A and 4B respectively illustrate a setting screen of a process mode (i.e., sheet selection and sheet processing selection) displayed at the operation displaying portion 600. Sheets to be used and punch holes can be selected therefrom.

When sheets to be used are selected from the screen of FIG. 4A, the CPU circuit portion 150 memorizes the sheet size and the sheet type to be used. On the screen of FIG. 4B, it is possible to set the stapling process or the punch process. When "Punch" is selected as illustrated in FIG. 4B, the CPU circuit portion 150 determines to perform the punch process. The size and type of the sheets and punch process information such as with-or-without performing punching set at FIGS. 4A and 4B are notified to the finisher controlling portion 580. The finisher 800 performs a process based on the notified information.

Block Diagram of Finisher

Figure 3:
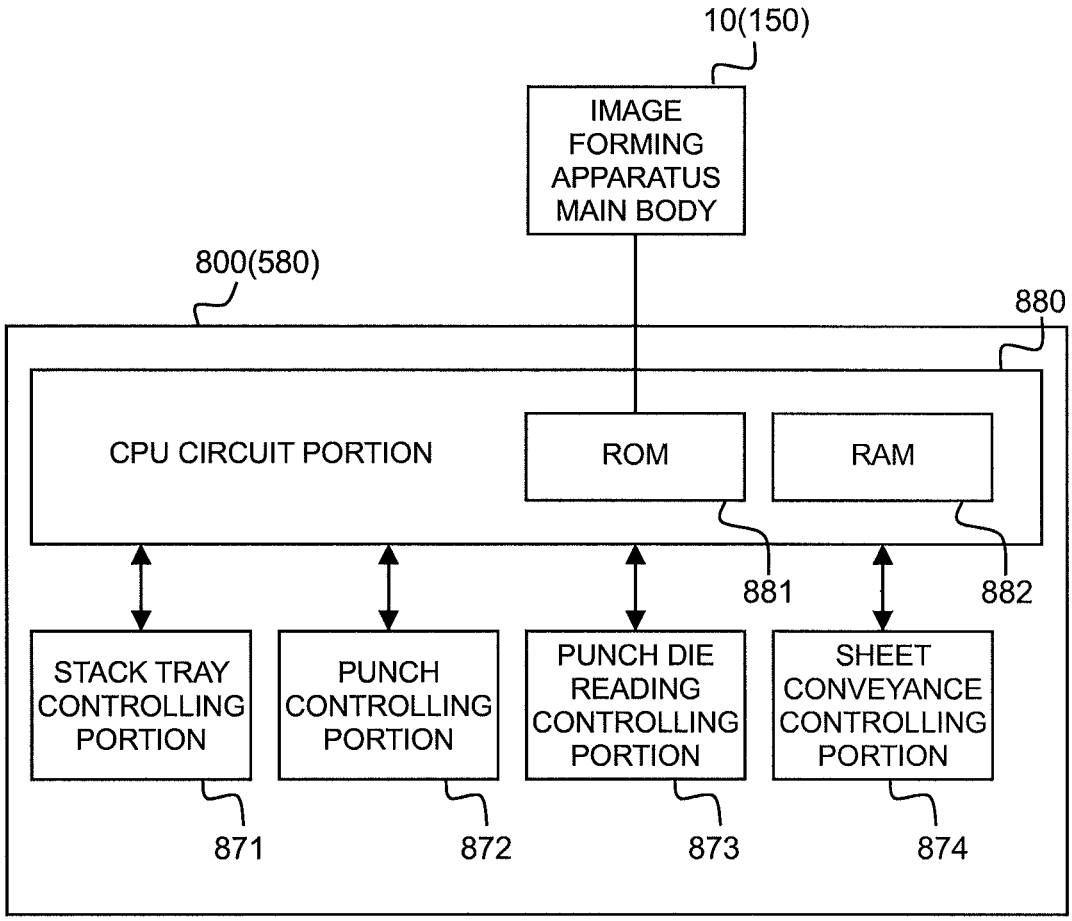
FIG. 3 is a block diagram of a finisher.

Next, the configuration of the finisher controlling portion 580 to control the finisher 800 will be described with reference to FIG. 3. FIG. 3 is a block diagram illustrating the configuration of the finisher controlling portion 580 of FIG. 2.

As illustrated in FIG. 3, the finisher controlling portion 580 being a controller is constituted with a CPU circuit portion 880, a ROM 881 and a RAM 882. The CPU circuit portion 880 performs data exchange by communicating with the CPU circuit portion 150 disposed at the image forming apparatus main body 10. Then, based on the instructions from the CPU circuit portion 150, the CPU circuit portion 880 generally controls respective blocks 871, 872, 873, 874 of the finisher 800 by executing various programs stored at the ROM 881.

In accordance with the sheet size, the sheet type and processing details notified from the finisher controlling portion 580, a stack tray controlling portion 871 controls lifting and lowering of the stack trays 510, 511. In description of the present embodiment, the finisher controlling portion 580 (i.e., the CPU circuit portion 880) is configured to communicate with the CPU circuit portion 150 disposed at the image forming apparatus main body 10. However, it is also possible that the CPU circuit portion 150 is configured to directly control the finisher 800.

A punch controlling portion 872 controls the punch unit 700 corresponding to the information of with-or-without performing punching notified from the finisher controlling portion 580.

A punch die reading controlling portion 873 controls the IC tag reader to perform reading of the information of the punch die 854 (i.e., the IC tag 868) when a punch die presence detecting sensor (not illustrated) detects mounting of the punch die 854. The read information of the punch die 854 (for example, as indicated in FIG. 5B) is stored to the RAM 882. Here, the information such as an ID of the punch die, number, diameter and shape of holes is obtained. For example, in the case of the punch die of 4 holes, the ID is 1, the number of holes is 4, the hole diameter is 8 mm, and the shape is circular.

A sheet conveyance controlling portion 874 controls sheet conveyance in accordance with the sheet size and the sheet type notified from the finisher controlling portion 580. In addition, the sheet conveyance controlling portion 874 also performs sheet discharge control to switch the sheet discharge method corresponding to with-or-without performing the punch process, the punch hole type and the sheet type.

Sheet Discharge Control of Finisher

Figure 8:
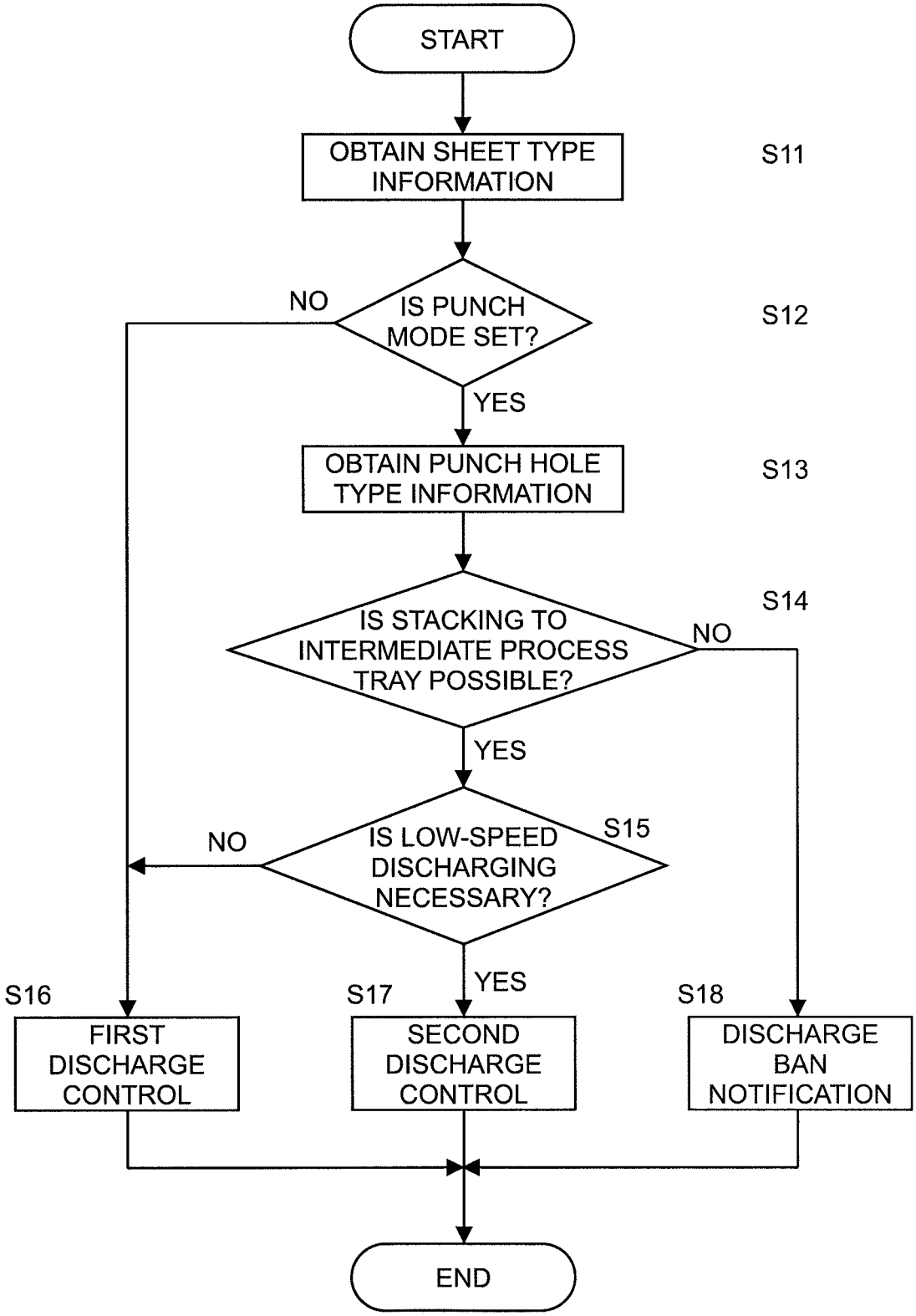
FIG. 8 is a flowchart which describes the flow of the discharge control according to the first embodiment.

Next, the sheet discharge control at the finisher 800 will be described with reference to FIGS. 7 and 8. FIG. 7 is a table indicating an example of the sheet discharge control according to the first embodiment. FIG. 8 is a flowchart describing the flow of the sheet discharge control according to the first embodiment.

As described above, when the sheet having the punch process of a number of holes performed is thin and large-sized, the strength of the sheet is decreased at the end part thereof where the punch process is performed. Therefore, there is a fear that the sheet is buckled by pushing out the sheet end part where the punch process is performed by the push-out member 509. Further, if the sheet having the punch process of a number of holes performed is thin, when the sheets are sequentially stacked on the intermediate process tray 508, there is a fear that the sheet end part is buckled due to abutment against the stopper plate 507.

Whether or not these problems occur is determined according to combination of punch process information such as with-or-without performing the punch process, a type of punch holes, a sheet size and a sheet type. Based on the punch process information, the sheet discharge control is performed in accordance with strength decrease at the sheet end part where the punch process is performed. In the following, the sheet discharge control is described with two examples.

First Discharge Control

The first discharge control is for the case that sheet buckling does not occur regardless of with-or-without performing punching, when a sheet having a predetermined strength or higher capable of being discharged at a predetermined speed is stacked to the intermediate process tray 508 or is stacked to the stack tray via the intermediate process tray 508. This control is normal discharge control to discharge a sheet to the stack tray 510 or the stack tray 511 at the predetermined discharge speed via the intermediate process tray 508.

Second Discharge Control

Figure 9:
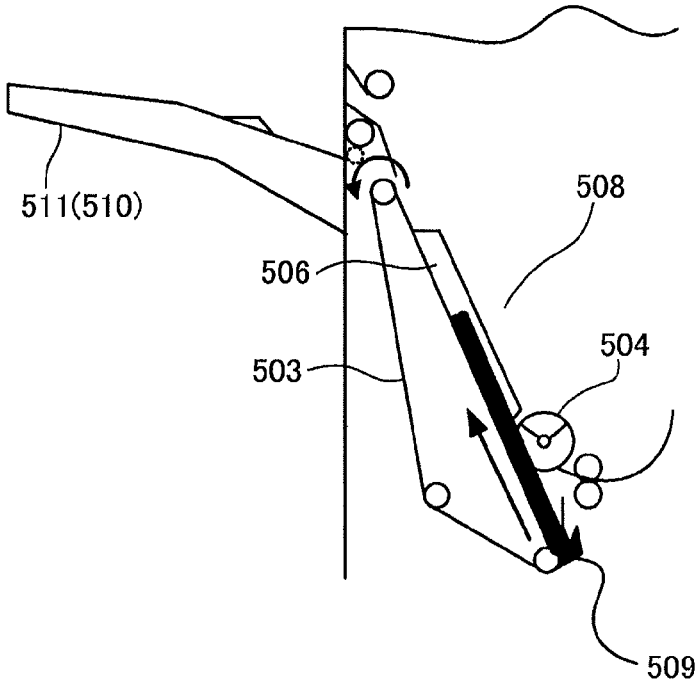
FIG. 9 is an explanatory view of a second discharge control.

The second discharge control is for preventing sheet buckling occurrence at the time of discharging a sheet to a stack tray from the intermediate process tray 508 even though buckling does not occur when the sheet having the punch process performed is stacked to the intermediate process tray 508. This control is the discharge control to discharge the punch-processed sheet which may have the abovementioned buckling toward the outside of the apparatus by the push-out member 509 constituting the first sheet discharge portion at the set speed of sheet discharging from the intermediate process tray 508 to be lower than the predetermined speed. Here, the predetermined speed refers to discharge speed V1 or discharge acceleration Va1 generated by the push-out member 509, as illustrated in FIG. 9. In the second discharge control, the discharging is performed at discharge speed V2 or at discharge acceleration Va2 being respectively lower than the discharge speed V1 or the discharge acceleration Va1 (i.e., V1>V2, Va1>Va2).

Notification of Not Permitting Discharge

Here, in the case that the end part of a punch-processed sheet is buckled by being abutted to the stopper plate 507 when being stacked to the intermediate process tray 508, it is notified that the sheet discharge process via the intermediate process tray 508 is not permitted. In other words, not permitting to perform the sheet alignment process in the longitudinal direction (i.e., the conveying direction) of the sheet by striking the punch-processed sheet end part to the stopper plate 507 (i.e., an abutment member) is notified. Since the notification is determined corresponding to the conditions of the punch process information at the time of sheet selection and sheet processing selection by utilizing the screen of FIG. 4, the notification is performed to the operation displaying portion 600 of FIG. 1 (or to a computer being an external host unit) in accordance with the conditions.

The discharge control is determined from the above two corresponding to a discharge control table prepared on the conditions of the punch process information where the strength of the end part of the punch-processed sheet is decreased. Here, the discharge control is determined corresponding to the discharge control table prepared by combination of with-or-without performing punching, a punch hole type, a sheet size and a sheet type, as illustrated in FIG. 7. The discharge control table illustrated in FIG. 7 is simply an example and the present invention is not limited to this.

In FIG. 7, combinations of a size and a type of sheets and number, a shape and a size of punch holes are exemplified as the punch process information relating to strength decrease of the end part of the punch-processed sheet. Here, B4 size (i.e., the length in the sheet discharge direction is 364 mm) is exemplified as the predetermined size of the sheet. The sheet type is referred to sheet thickness. Here, plain paper is exemplified as a predetermined thickness. In this example, thick paper is thicker and thin paper is thinner than the plain paper. The number of holes, the hole diameter (i.e., the size) and the hole shape are exemplified as the hole information.

The sheet having 4 circular holes has the predetermined strength or higher capable of being discharged at the predetermined speed and receives no influence by the punch process. Accordingly, as indicated in the discharge control table of FIG. 7, the first discharge control being the same without the punch process is performed in all combinations.

In the case of the sheet of thin paper having 30 circular holes and length of B4 (=364 mm) or longer, the sheet has the first strength being lower than the predetermined strength. With this strength, the end part of the punch-processed sheet is not buckled when being abutted to the stopper plate 507 but is buckled when being pushed by the push-out member 509 at the predetermined speed. Accordingly, with the sheet of such combination, the sheet is discharged by the push-out member at the speed of being discharged from the intermediate process tray 508 being lower than the predetermined speed (i.e., the second discharge control). Even in the case of the sheet having 30 circular holes and length of B4 (=364 mm) or longer, the sheet of plain paper or thick paper has the predetermined strength or higher capable of being discharged at the predetermined speed and the end part of the punch-processed sheet is not buckled. Accordingly, the sheet is discharged by the push-out member driven at the predetermined speed (i.e., the first discharge control). Further, in the case of the sheet having 30 circular holes and length shorter than B4 (=364 mm), the sheet even of thin paper has the predetermined strength or higher capable of being discharged at the predetermined speed not to be buckled. Accordingly, the sheet is discharged by the push-out member driven at the predetermined speed (i.e., the first discharge control).

In the case of the sheet of thin paper having 30 rectangular holes and length of B4 (=364 mm) or longer, the sheet has the second strength being lower than the predetermined strength. With this strength, the end part of the punch-processed sheet is buckled when being abutted to the stopper plate 507 of the intermediate process tray 508. Accordingly, with the sheet of such combination, it is notified to a user via the operation displaying portion 600 that the sheet discharge process via the intermediate process tray 508 is not permitted (i.e., notification of not permitting discharge). Even in the case of the sheet having 30 rectangular holes and length of B4 (=364 mm) or longer, the sheet of plain paper or thick paper has the predetermined strength or higher capable of being discharged at the predetermined speed and the end part of the punch-processed sheet is not buckled. Accordingly, the sheet is discharged by the push-out member driven at the predetermined speed (i.e., the first discharge control).

In the case of the sheet of thin paper having 30 rectangular holes and length shorter than B4 (=364 mm), the sheet has the first strength being lower than the predetermined strength. With this strength, the end part of the punch-processed sheet is not buckled when being abutted to the stopper plate but is buckled when being pushed by the push-out member at the predetermined speed. Accordingly, with the sheet of this combination, the sheet is discharged by the push-out member at the speed of being discharged from the intermediate process tray being lower than the predetermined speed (i.e., the second discharge control). Even in the case of the sheet having 30 rectangular holes and length shorter than B4 (=364 mm), the sheet of plain paper or thick paper has the predetermined strength or higher capable of being discharged at the predetermined speed and the end part of the punch-processed sheet is not buckled. Accordingly, the sheet is discharged by the push-out member driven at the predetermined speed (i.e., the first discharge control).

Here, although the discharge control table is prepared with the combinations of three hole types of the punch die 854, two sheet sizes and three sheet types, the combinations are not limited thereto. For example, it is also possible to classify the sheet types more finely by grammage and sheet length and to combine the types.

Next, the sheet discharge control of the finisher 800 will be described with reference to a flowchart of FIG. 8. In the following description, the punch process information refers to combinations of information of sheet types, information of with-or-without performing punch process and information of punch holes.

In S11, when sheet passing is started, the finisher controlling portion 580 (i.e., the CPU circuit portion 880) of the finisher 800 obtains sheet type information such as the sheet size and the sheet type which are set at the sheet selection screen of the operation displaying portion 600 of FIG. 4A through the communication with the CPU circuit portion 150. Then, it proceeds to S12.

In S12, the finisher controlling portion 580 of the finisher 800 obtains the information of with-or-without performing the punch process set at the sheet process selection screen of the operation displaying portion 600 of FIG. 4B through the communication with the CPU circuit portion 150. When the punch process is to be performed, it proceeds to S13. When the punch process is not to be performed, it proceeds to S16 and the sheet discharge method is determined to be the first discharge control.

In S13, the information from the punch die reading controlling portion 873 is obtained and the hole types (the number, shape and size of holes) of the punch process to be performed are determined.

In S14, it is determined whether or not buckling occurs when stacking to the intermediate process tray 508 corresponding to the combination of the obtained sheet type, information of with-or-without performing the punch process and the punch hole type information. When the combination is not for causing buckling, it proceeds to S15. When the combination is for causing buckling, it is notified to the operation displaying portion 600 that the sheet discharge process is not permitted, as proceeding to S18.

In S15, it is determined whether or not discharging in low speed for buckling prevention is necessary when the sheet is discharged from the intermediate process tray 508 corresponding to the combination of the obtained sheet type, information of with-or-without performing the punch process and the punch hole type information. If necessary to discharge in low speed, the sheet discharge method is determined to be the second discharge control, as proceeding to S17. If not necessary to discharge in low speed, the first discharge control as the sheet discharge method in the case of not performing the punch process is determined, as proceeding to S16.

With the abovementioned steps, an appropriate sheet discharge method is determined corresponding to the combination of the sheet type, information of with-or-without performing the punch process and the punch hole type information. Accordingly, appropriate sheet control is performed in accordance with strength decrease at the end part of the punch-processed sheet, so that buckling can be prevented at the end part of the sheet having decreased strength due to punch processing. In this manner, a sheet product on which a high quality punch process is performed can be provided to a user.

Second Embodiment

Next, an image forming system constituted with an image forming apparatus main body and a sheet processing apparatus according to a second embodiment will be described. Here, since the general configuration of the image forming system is substantially the same as the abovementioned embodiment, only the sheet discharge control of the finisher will be described in the following.

Sheet Discharge Control of Finisher

Figure 11:
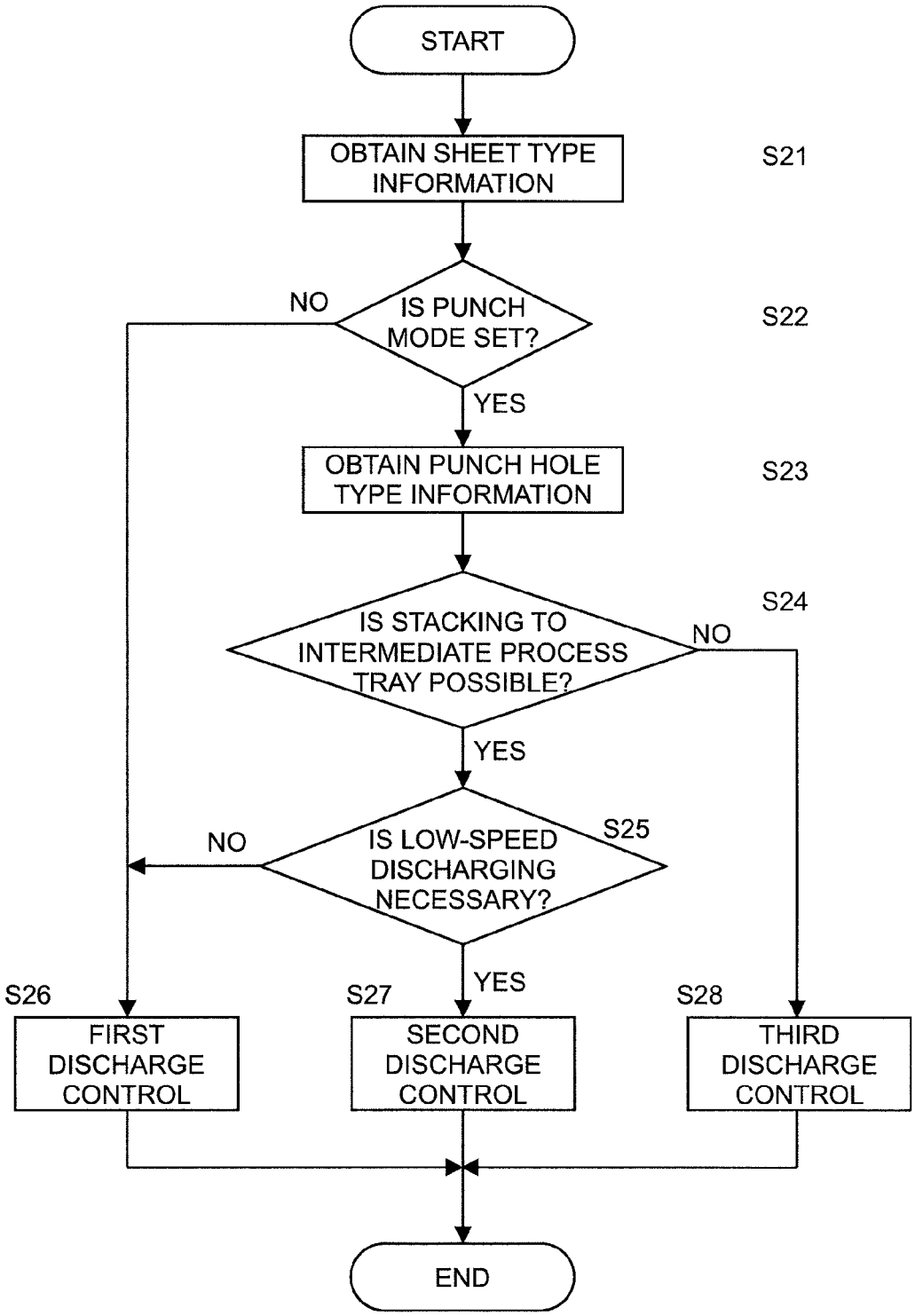
FIG. 11 is a flowchart which describes the flow of the discharge control according to the second embodiment.

Next, the sheet discharge control at the finisher 800 will be described with reference to FIGS. 10 and 11. FIG. 10 is a table indicating an example of the sheet discharge control according to the second embodiment. FIG. 11 is a flowchart describing the flow of the sheet discharge control according to the second embodiment.

In the description of the above embodiment, two sheet discharge controls are performed in accordance with decrease of the strength at the end part of the punch-processed sheet based on the punch process information as an example. In the present embodiment, the sheet discharge control includes the following three controls as an example.

Since the first discharge control and the second discharge control are substantially the same as those in the above embodiment, only the third discharge control will be described in the following.

Third Discharge Control

Figure 12:
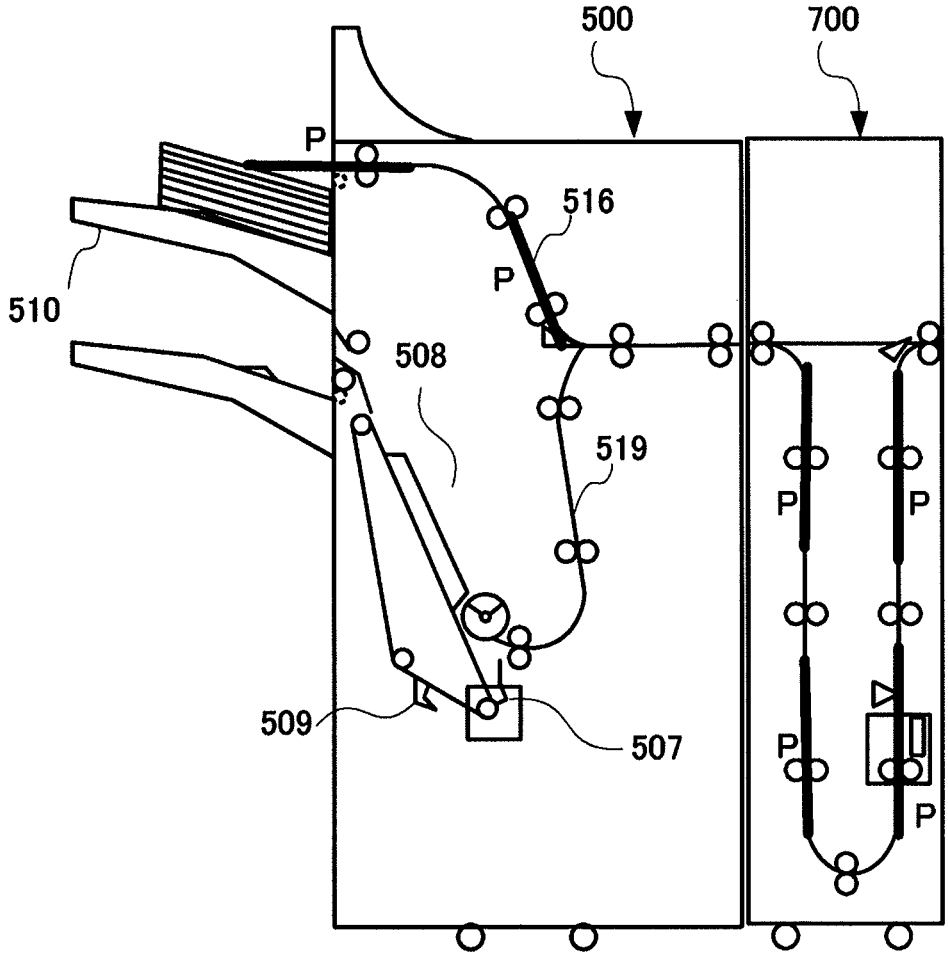
FIG. 12 is an explanatory view of a third discharge control.

The third discharge control is for the case that buckling occurs due to contact of the end part of the punch-processed sheet to the stopper plate 507 when the punch-processed sheet is stacked to the intermediate process tray 508. The control is the discharge control to discharge the punch-processed sheet which may have the abovementioned buckling toward the outside of the apparatus by the discharge roller 517 being the second sheet discharge portion using the non-sort path 516 not by way of the intermediate process tray 508, as illustrated in FIG. 12. Here, the sheet is discharged to the stack tray 510. Although the discharging is performed through the non-sort path 516, the discharge method is not limited to the above as long as being not by way of the intermediate process tray 508.

The discharge control is determined from the above three corresponding to a discharge control table prepared on the conditions of the punch process information where the strength of the end part of the punch-processed sheet is decreased. Here, the discharge control is determined corresponding to the discharge control table prepared by combination of with-or-without performing punching, a punch hole type, a sheet size and a sheet type, as illustrated in FIG. 10. The discharge control table illustrated in FIG. 10 is simply an example and the present invention is not limited to this.

In FIG. 10, combinations of a size and a type of sheets and number, a shape and a size of punch holes are exemplified as the punch process information relating to strength decrease of the end part of the punch-processed sheet. Here, B4 size (i.e., the length in the sheet discharge direction is 364 mm) is exemplified as the predetermined size of the sheet. The sheet type is referred to sheet thickness. Here, plain paper is exemplified as a predetermined thickness. In this example, thick paper is thicker and thin paper is thinner than the plain paper. The number of holes, the hole diameter (i.e., the size) and the hole shape are exemplified as the hole information.

Since the sheet having 4 circular holes receives no influence by the punch process, the first discharge control being the same without the punch process is performed in all combinations, as indicated in the discharge control table of FIG. 10.

In the case of the sheet of thin paper having 30 circular holes and length of B4 (=364 mm) or longer, the sheet has the first strength being lower than the predetermined strength. With this strength, the end part of the punch-processed sheet is not buckled when being abutted to the stopper plate of the intermediate process tray but is buckled when being pushed by the push-out member. Accordingly, with the sheet of this combination, the sheet is discharged by the push-out member at the speed of being discharged from the intermediate process tray being lower than the predetermined speed (i.e., the second discharge control). Even in the case of the sheet having 30 circular holes and length of B4 (=364 mm) or longer, the sheet of plain paper or thick paper has the predetermined strength or higher capable of being discharged at the predetermined speed and the end part of the punch-processed sheet is not buckled. Accordingly, the sheet is discharged by the push-out member driven at the predetermined speed (i.e., the first discharge control). Further, in the case of the sheet having 30 circular holes and length shorter than B4 (=364 mm), the sheet even of thin paper has the predetermined strength or higher capable of being discharged at the predetermined speed not to be buckled. Accordingly, the sheet is discharged by the push-out member driven at the predetermined speed (i.e., the first discharge control).

In the case of the sheet of thin paper having 30 rectangular holes and length of B4 (=364 mm) or longer, the sheet has the second strength being lower than the predetermined strength. With this strength, the end part of the punch-processed sheet is buckled when being abutted to the stopper plate of the intermediate process tray. Accordingly, with the sheet of this combination, the sheet is discharged by the discharge roller 517 using the non-sort path 516 not by way of the intermediate process tray (i.e., the third discharge control). Even in the case of the sheet having 30 rectangular holes and length of B4 (=364 mm) or longer, the sheet of plain paper or thick paper has the predetermined strength or higher capable of being discharged at the predetermined speed and the end part of the punch-processed sheet is not buckled. Accordingly, the sheet is discharged by the push-out member driven at the predetermined speed (i.e., the first discharge control).

In the case of the sheet of thin paper having 30 rectangular holes and length shorter than B4 (=364 mm), the sheet has the first strength being lower than the predetermined strength. With this strength, the end part of the punch-processed sheet is not buckled when being abutted to the stopper plate but is buckled when being pushed by the push-out member at the predetermined speed. Accordingly, with the sheet of this combination, the sheet is discharged by the push-out member at the speed of being discharged from the intermediate process tray being lower than the predetermined speed (i.e., the second discharge control). Even in the case of the sheet having 30 rectangular holes and length shorter than B4 (=364 mm), the sheet of plain paper or thick paper has the predetermined strength or higher capable of being discharged at the predetermined speed and the end part of the punch-processed sheet is not buckled. Accordingly, the sheet is discharged by the push-out member driven at the predetermined speed (i.e., the first discharge control).

Since the end part of the punch-processed sheet in the case of rectangular holes (i.e., the hole shape is square) as illustrated in FIG. 6B is decreased compared to that in the case of circular holes as illustrated in FIG. 6C even with the same 30 holes, the third discharge control is performed as described above.

Here, although the discharge control table is prepared with the combinations of three hole types of the punch die 854, two sheet sizes and three sheet types, the combinations are not limited thereto. For example, it is also possible to classify the sheet types more finely by grammage and sheet length and to combine the types.

Next, the sheet discharge control of the finisher 800 will be described with reference to a flowchart of FIG. 11. In the following description, the punch process information refers to combinations of information of sheet types, information of with-or-without performing punch process and information of punch holes.

In S21, when sheet passing is started, the finisher controlling portion 580 of the finisher 800 obtains sheet type information such as the sheet size and the sheet type which are set at the sheet selection screen of the operation displaying portion 600 of FIG. 4A through the communication with the CPU circuit portion 150. Then, it proceeds to S22.

In S22, the finisher controlling portion 580 (i.e., the CPU circuit portion 880) of the finisher 800 obtains the information of with-or-without performing the punch process set at the sheet process selection screen of the operation displaying portion 600 in FIG. 4B through the communication with the CPU circuit portion 150. When the punch process is to be performed, it proceeds to S23. When the punch process is not to be performed, it proceeds to S26 and the sheet discharge method is determined to be the first discharge control.

In S23, the information from the punch die reading controlling portion 873 is obtained and the hole types (the number, shape and size of holes) of the punch process to be performed are determined.

In S24, it is determined whether or not buckling occurs when stacking to the intermediate process tray 508 corresponding to the combination of the obtained sheet type, information of with-or-without performing the punch process and the punch hole type information. When the combination is not for causing buckling, it proceeds to S25. When the combination is for causing buckling, the sheet discharge method is determined to be the third discharge control, as proceeding to S28.

In S25, it is determined whether or not discharging in low speed for buckling prevention is necessary when the sheet is discharged from the intermediate process tray 508 corresponding to the combination of the obtained sheet type, information of with-or-without performing the punch process and the punch hole type information. If necessary to discharge in low speed, the sheet discharge method is determined to be the second discharge control, as proceeding to S27. If not necessary to discharge in low speed, the first discharge control as the sheet discharge method in the case of not performing the punch process is determined, as proceeding to S26.

With the abovementioned steps, an appropriate sheet discharge method is determined corresponding to the combination of the sheet type, information of with-or-without performing the punch process and the punch hole type information. Accordingly, appropriate sheet control is performed in accordance with strength decrease at the end part of the punch-processed sheet, so that buckling can be prevented at the end part of the sheet having decreased strength due to punch processing. In this manner, a sheet product on which a high quality punch process is performed can be provided to a user.

In the example of the above embodiment, plural types of punch processes can be performed with the configuration that plural types of punch dies 854 are exchangeable in one punch unit 700. However, not limited to this, it is also possible to configure to actualize the plural punch processes by connecting plural punch units 700, for example. Instead, it is also possible that plural types of punch dies (for example, 3 holes and 30 holes) are switchably disposed to one punch unit. Here, as the configuration to switchably dispose the plural types of punch dies, it is considered to dispose punch dies of 3 holes and 30 holes at a rotary member and to switch the punch die by rotating the rotary member.

Further, in the example of the above embodiment, the apparatus can perform the punch process with plural punch hole types. However, the punch hole type of the apparatus may be fixed to one type. In that case, the punch hole type to be obtained on the punch hole type obtaining process in S13 and S23 of the flowchart of the abovementioned sheet discharge control is simply to be a predetermined punch hole type. Then, subsequent steps to determine the sheet discharge method are kept the same.

Further, in the above embodiment, a black and white image forming apparatus is described as an example. However, not limited to this, a color image forming apparatus having plural image forming portions of different colors can be adopted.

Further, in the above embodiment, a copying machine is described as an example of the image forming apparatus main body of the image forming system. However, not limited to this, it is also possible to adopt another image forming main body such as a printer, a facsimile machine and a multi-function machine combining the functions thereof. Substantially the same effects can be obtained by applying the present invention to a sheet processing apparatus being combined with the abovementioned image forming apparatus main body.

Furthermore, in the example of the above embodiment, the sheet processing apparatus is detachably attachable to the image forming apparatus main body. However, the present invention is not limited to this. For example, the sheet processing apparatus may be integrated with the image forming apparatus main body. In this case, by applying the present invention to the sheet processing apparatus as well, substantially the same effects can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-161391, filed Jul. 8, 2009, and No. 2010-138829, filed Jun. 18, 2010, which are hereby incorporated by reference herein in their entirety.

What is claimed is:

1. A sheet processing apparatus comprising:

a punch portion which punches a hole at an end part of a sheet;

a sheet conveying portion which conveys the sheet, on which a punch process is performed by the punch portion, by pushing the end part of the sheet where the punch process is performed by the punch portion; and a controller which controls the sheet conveying portion, wherein the controller controls the sheet conveying portion so that the sheet conveying portion conveys a sheet at a sheet conveying speed lower than a predetermined speed in accordance with punch process information indicating that a strength of a sheet end part is decreased by the punch process and is lower than a predetermined sheet strength of a sheet capable of being conveyed at the predetermined speed.

2. The sheet processing apparatus according to claim 1, wherein the punch process information is a combination of a size and a type of the sheet and a number, a shape and a size of holes to be punched at the sheet end part.

3. The sheet processing apparatus according to claim 1, wherein the controller controls the sheet conveying portion so that:

a sheet having circular holes punched at an end part thereof is conveyed by the sheet conveying portion at the sheet conveying speed lower than the predetermined speed in a case that a sheet length in the conveying direction is longer than a predetermined length, a sheet thickness is thinner than a predetermined thickness and a number of holes is more than a predetermined number, and a sheet having rectangular holes punched at an end part thereof is conveyed by the sheet conveying portion at the sheet conveying speed lower than the predetermined speed in a case that a sheet thickness is thinner than the predetermined thickness and a number of holes is more than the predetermined number, even when sheet length in the conveying direction is shorter than the predetermined length.

4. The sheet processing apparatus according to claim 1, wherein the punch portion is capable of selectively punching holes of different types by being provided with a plurality of detachably attachable blade portions having different hole types and by exchanging the blade portions.

5. The sheet processing apparatus according to claim 1, wherein the punch portion is capable of selectively punching holes of different types by switchably including a plurality of blade portions having different hole types and by switching the blade portions.

6. The sheet processing apparatus according to claim 1, further comprising:

a first stack portion which is capable of stacking punch-processed sheets by the punch portion, wherein the sheet conveying portion conveys the sheets stacked on the first stack portion toward a second stack portion by pushing the punch-processed end parts of the sheets.

7. An image forming system comprising:

an image forming portion which forms an image on a sheet;

a sheet processing portion which selectively performs a process on the image-formed sheet; and a controller which controls the sheet processing portion, wherein the sheet processing portion includes a punch portion which punches a hole at an end part of a sheet, and a sheet conveying portion which conveys the sheet, on which a punch process is performed by the punch portion, by pushing the end part of the sheet where the punch process is performed by the punch portion, and wherein the controller controls the sheet conveying portion so that the sheet conveying portion conveys a sheet at a sheet conveying speed lower than a predetermined speed in accordance with punch process information that a strength of a sheet end part is decreased by the punch process and is lower than a predetermined sheet strength of a sheet capable of being conveyed at the predetermined speed.

8. The image forming system according to claim 7, wherein the sheet conveying portion conveys a sheet against which a sheet alignment process is performed by striking the punch-processed sheet end part to an abutment member, and wherein a lack of permission to perform the sheet alignment process by striking the punch-processed sheet end part to the abutment member is notified, in accordance with punch process information indicating that the sheet to be conveyed has a sheet strength, lower than the predetermined sheet strength, that causes buckling when the punch-processed sheet end part is struck to the abutment member.

9. The image forming system according to claim 7, wherein the punch process information is a combination of a size and a type of the sheet and a number, a shape and a size of holes to be punched at the sheet end part.

10. The image forming system according to claim 7, wherein the controller controls the sheet conveying portion so that:

a sheet having circular holes punched at an end part thereof is conveyed by the sheet conveying portion at the sheet conveying speed lower than the predetermined speed in a case that a sheet length in the conveying direction is longer than a predetermined length, a sheet thickness is thinner than a predetermined thickness and a number of holes is more than a predetermined number, a sheet having rectangular holes punched at an end part thereof is conveyed by the sheet conveying portion at the sheet conveying speed lower than the predetermined speed in a case that a sheet thickness is thinner than the predetermined thickness and a number of holes is more than the predetermined number, even when a sheet length in the conveying direction is shorter than the predetermined length, and wherein a lack of permission to perform the sheet alignment process by striking the punch-processed sheet end part to the abutment member is notified with a sheet having rectangular holes punched at an end part thereof in a case that a sheet length in the conveying direction is longer than the predetermined length, a sheet thickness is thinner than the predetermined thickness and number of the holes is more than the predetermined number.

11. The image forming system according to claim 7, wherein the punch portion is capable of selectively punching holes of different types by being provided with a plurality of detachably attachable blade portions having different hole types and by exchanging the blade portions.

12. The image forming system according to claim 7, wherein the punch portion is capable of selectively punching holes of different types by switchably including a plurality of blade portions having different hole types and by switching the blade portions.

13. The image forming system according to claim 7, further comprising:

a first stack portion which is capable of stacking punch-processed sheets by the punch portion, wherein the sheet conveying portion conveys the sheets stacked on the first stack portion toward a second stack portion by pushing the punch-processed end parts of the sheets.

* * * * *